US005823241A

United States Patent [19]

Sitzes et al.

[11] Patent Number: 5,823,241

[45] Date of Patent: Oct. 20, 1998

[54] USER FITTABLE VENETIAN BLINDS FOR DIFFERING ARCHED WINDOWS

[76] Inventors: Steven O. Sitzes, 1742 Sandpiper, Abilene, Tex. 79602; Keith B. Turner, 5002 S. 11th St., Abilene, Tex. 79605

[21] Appl. No.: 931,348

[22] Filed: Sep. 16, 1997

[51] Int. Cl.[6] ..... A47H 1/00

[52] U.S. Cl. ..... 160/107; 16/249; 16/387; 52/204.61; 52/663; 160/104

[58] Field of Search ..... 160/166.1 R, 168.1 R, 160/173 R, 178.1 R, 104, 134, 84.07, 902, 172 R, 370.21, 107; 49/39, 40, 403; 52/85, 204.61, 663, 668; 16/249, 387; 454/221, 224, 225

[56] References Cited

U.S. PATENT DOCUMENTS

| | | | |
|---|---|---|---|
| 781,905 | 2/1905 | Plfeghar | 16/387 |
| 1,050,092 | 1/1913 | Beall | 16/249 |
| 2,509,033 | 5/1950 | Carver . | |
| 2,612,220 | 9/1952 | Turkowski . | |
| 2,618,331 | 11/1952 | Hicks et al. | 160/223 |
| 2,885,722 | 5/1959 | Halliday . | |
| 3,113,356 | 12/1963 | Piper | 52/668 X |
| 3,453,792 | 7/1969 | Ceder | 160/104 X |
| 4,518,025 | 5/1985 | Judkins . | |
| 4,932,710 | 6/1990 | Chen | 160/370.21 X |
| 5,000,242 | 3/1991 | Coddens | 160/107 |
| 5,632,316 | 5/1997 | Cohen . | |
| 5,664,615 | 9/1997 | Baik | 160/370.21 |

*Primary Examiner*—David M. Purol
*Attorney, Agent, or Firm*—Joseph F. Long

[57] ABSTRACT

A user fittable and user mountable blind for an arched window comprising a minimum of two rigid slat hangers with angled slots to hold trimmable slats as long as the widest part of the window in the hangers and adjustable hinges with one short side to connect to the hangers and a slotted longer side to allow fastening to a top part of the window frame with a single mounting screw or to allow fastening to a mounting block slidably held in a track mounted in a top part of the window frame. After moving the adjustable hinges using the mounting block or utilizing the slot in the hinge to bring the slats to a horizontal position the user may trim the slats to exactly fit the window frame.

3 Claims, 3 Drawing Sheets

USER FITTABLE VENETIAN BLINDS FOR DIFFERING ARCHED WINDOWS

BACKGROUND OF THE INVENTION

Arched windows with differing shaped arches are becoming quite popular in both residential and commercial buildings. However these arches are seldom fitted with venetian blinds even when the adjoining normal windows are so equipped. This is probably because each venetian blind for these arched windows would currently be custom made to fit. This invention is aimed at filling the need for a low cost user fittable blind that may be used on differing shaped arches.

With the blinds of this invention the user orders a blind giving the manufacturer the maximum width and maximum height of the window.

There are two embodiments of the invention. In both embodiments the user trims the ends of the slats to fit his particular arch. In the first embodiment the slats are held at a fixed angle in two hanger strips that are spaced about as far apart as the desired length of the uppermost slat, usually less than two feet for narrow windows while multiple slats may be used for wide windows. The hanger strips are as long as the window and are fitted with slats that are full width of the window. Each hanger strip is attached to the short side of a hinge having a longer slotted side. The user attaches the longer slotted side to the upper part of the window frame or to mounting blocks slidable in a track for some wider windows. Both slots in the hinge and movable mounting blocks allow movement to adjust the slats to a horizontal position before tightening the mounting screws rigidly in place. With the blind so mounted the user trims each slat to fit inside the frame to complete the installation. Generally the slats are made of thin aluminum and the user may trim the slats with a pair of scissors; however the slats may be plastic metal, or wood.

In the second embodiment the slats are hung from the normal type venetian blind hanger using a narrow hanger, usually less than two feet long in order to fit close to the top of the arch. The same adjustable mounting hinges are used in the same way as in the first embodiment to get the slats level before the user trims the slats to fit the arch.

SUMMARY OF THE INVENTION

The invention comprises two major embodiments, both embodiments allow a user to shorten some slats by trimming to provide a venetian blind for an arched portion of a window or for both an arched and straight portion of a window fabricated with both an arched and straight portion. In the first embodiment two or more rigid hanger strips with slots to firmly hold slats in a fixed position with slats the maximum width of the window and with hanger strips the maximum length of the window are furnished to the user along with specially designed adjustable hinges and mounting strips. The user may adjust the hanger strips to be close together for a steeply arched window or relatively farther apart for a window with a broader arch such as a semicircle. The adjustable hinges allow a user to loosely fasten the hanger strips to the top of the window casing or in the instance of larger windows to mounting blocks that slide in a track. The user may slide the hinges to bring the slats to a horizontal position and when the hinges are fastened to mounting blocks may slide both the mounting blocks and the hinges before fastening the hinges solidly in place. The user then trims the slats to fit the window. The curved U shaped track segments are fastened to the top of the window arch and the longer side of the special mounting hinge is fastened to the mounting block that slides in the curved U shaped track.

In the second embodiment a normal narrow venetian blind hanger with cloth hanging and slat support strips is used to allow tilting the slats and the hanger is fastened in place with the same type adjustable hinge as used for the fixed slat hanger. This embodiment is best suited for windows wherein a slat that is about a two inches wide is desirable.

DESCRIPTION OF THE INVENTION

Figure 1:
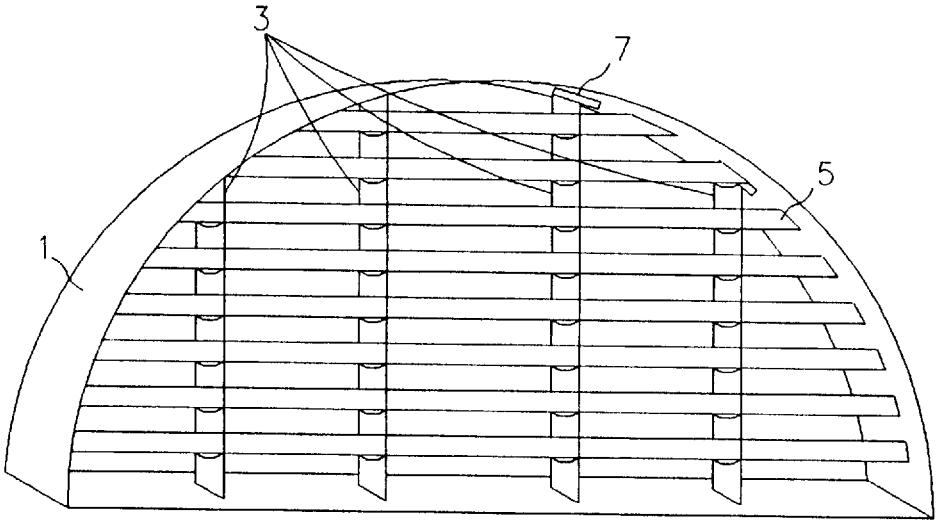
FIG. 1 shows a three dimensional view of the first embodiment of the invention.

The invention may best be described from the drawings. In the first major embodiment, FIG. 1 shows an angle view of an arched window 1 with rigid hanger strips 3 slotted to hold slats 5 in a fixed angled position as shown more clearly in FIG. 4. Four hanger strips are shown; however two hanger strips would be used with narrow windows and in very wide windows multiple hanger strips would be used. Enough hanger strips are used to prevent one inch wide slats from sagging between the hanger strips or from drooping at the outer ends. The slats 5 are normally thin aluminum and are easily cut with household scissors. Metals other than aluminum and wood or plastic may also be used for slats. The manufacturer ships the unit to the user with all slats as long as the maximum width of the window and with hanger strips 3 at the user specified length or maximum height of the window. The user fastens the special hinges 7, described in FIG. 3, loosely in place and slides the hinges to get the slats 5 in a horizontal position before rigidly fastening the hinges in place and trimming the ends of the slats to fit inside the window frame.

Figure 2B:
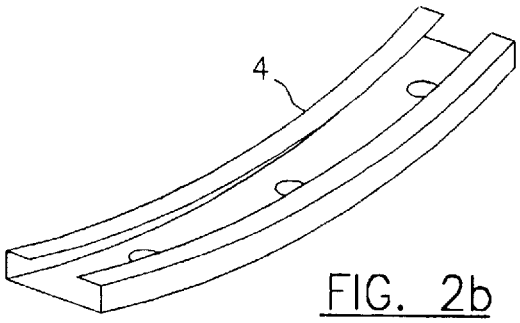
FIG. 2*b* shows a U shaped track sized to allow the hinge support block to slide in the U shaped track.
Figure 2A:
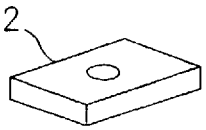
FIG. 2*a* shows a view of a hinge support block.

FIG. 2*a* shows a hinge mounting block 2 that slides in a U shaped track 4, FIG. 2*b*, that fastens to the arched portion of a window frame. There may be multiple pairs of these blocks in a large window.

Figure 3:
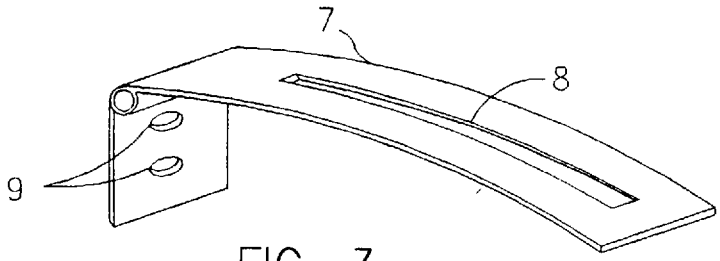
FIG. 3 shows a three dimensional view of a slotted hinge that may be used to fasten directly to a window frame or to the track mounted support block.
Figure 4:
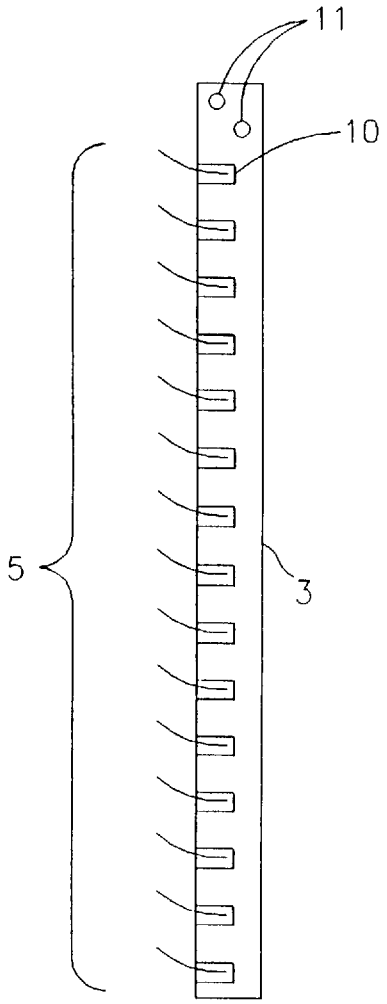
FIG. 4 shows slats in a fixed position in the first embodiment.

In FIG. 3 the special hinge 7 is shown with openings 9 in the short side to allow fastening to hanger strip 3, with screws fitting into openings 11, FIG. 4. A screw is placed about midway in the slot 8 to fasten hanger strip 3 loosely either to the window facing 1 or where the U shaped track 4 is used to mounting block 2 that slides in track 4. Slats in the unit may be adjusted to hang level by movement of the hinge before fastening rigidly in position when the slotted side of the hinge is fastened directly to the window frame or may be adjusted by moving the snug fitting mounting block 2 when using the U shaped track 4 and fastening the slotted side of the hinge to the mounting block 2 thereby allowing limited movement of the hinge as well as movement of the mounting block.

FIG. 4 shows a side view of a hanger 3 with angled slots 10 to hold slats 5 which are normally curved but could be flat in particular cases. Openings 11 are to receive screws to fasten the short side of hinge 7, FIG. 3 to hanger 3.

Figure 5:
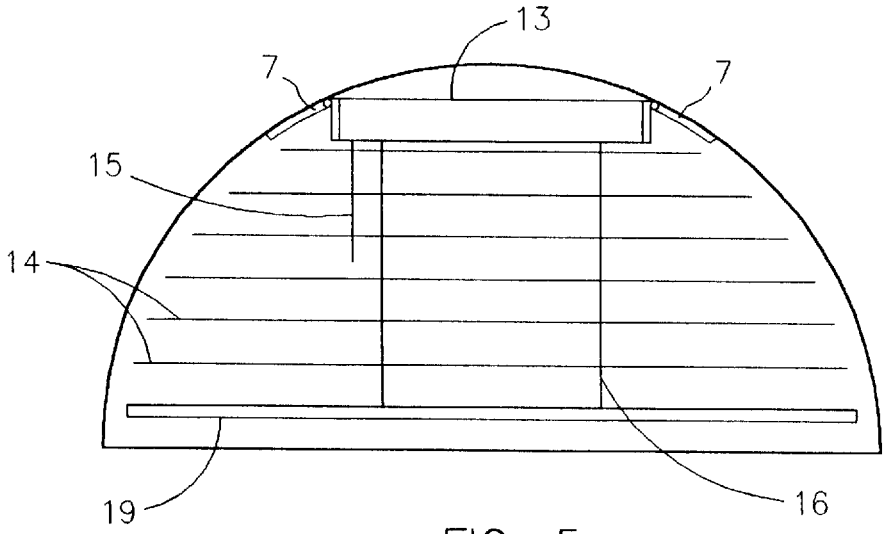
FIG. 5 shows the second embodiment wherein a specially made venetian blind with adjustable slats is user fittable.

FIG. 5 shows a second embodiment of the invention. In this embodiment or version a normal type venetian blind hanger 13 is fastened to a window casing or frame with the same type of slidable hinge 7 as used in the previous embodiment. Cloth strips 16 are used to support and allow tilting of the slats in the normal manner. Slat tilt rod 15 is normally a clear plastic rod and quite unobtrusive. A bar 19 may be relatively narrow to match the slats 14.

Figure 6:
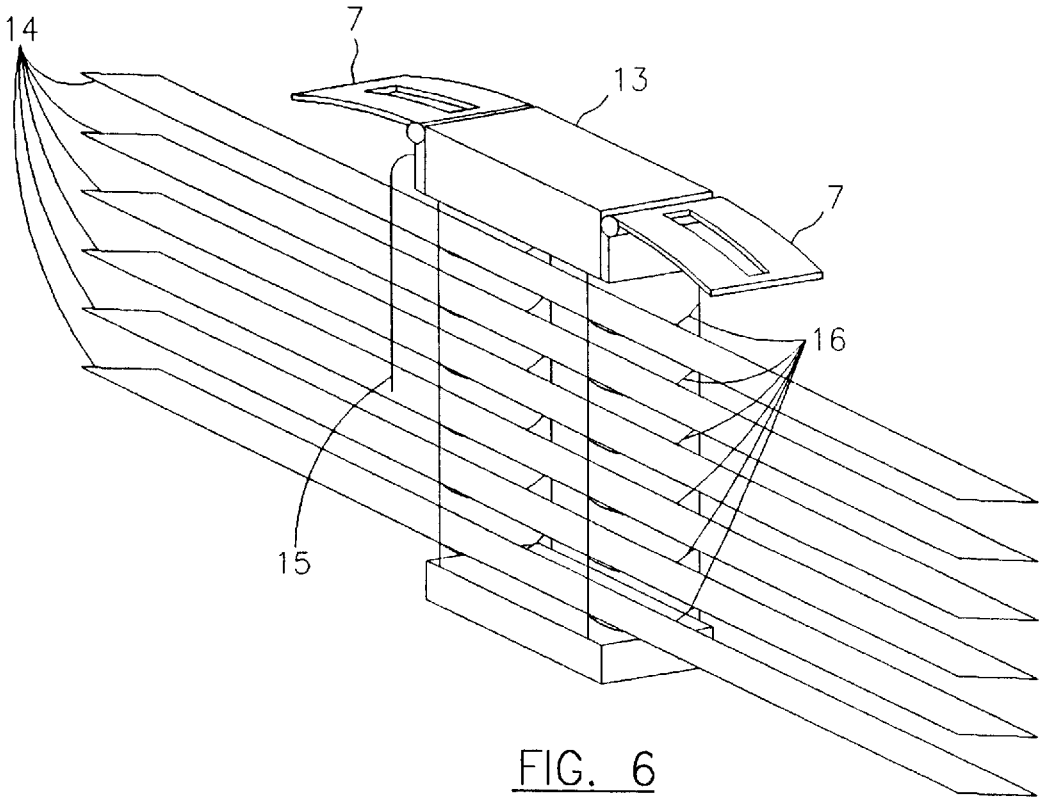
FIG. 6 shows a three dimensional view of the second embodiment as it would be before user trimming to fit.

FIG. 6 shows a three dimensional view of the same embodiment as shown in FIG. 5 as the unit would appear before user completion of the installation. All components are as previously described.

What is claimed is:

1. A user fittable Venetian blind comprising:

a) an arched window frame and an arched window therein, b) a minimum of two rigid hanger strips and multiple slats, said hanger strips having multiple angled slots sized to snugly hold said multiple slats therein with said hanger strips being a minimum of about one foot apart and all of said slats being as long as the widest part of said window;

c) adjustable hinges with each of said hinges having a short side with an opening to allow fastening to a top end of each of said hanger strips and a curved slotted long side to allow loosely fastening in a center of said slot to said arched window frame and to allow a user to slide said hinges until said slats are exactly horizontal before trimming said slats to fit inside said frame and tightening said fasteners to hold said strips rigidly in place.

2. A user fittable venetian blind comprising:

a) an arched window frame and an arched window therein, b) a minimum of two rigid hanger strips and multiple slats, said hanger strips having multiple angled slots sized to snugly hold said multiple slats therein with said hanger strips being a minimum of about one foot apart and all of said slats being as long as the widest part of said arched window frame;

c) a mounting block means and a curved track means; said curved track means being mountable in a top curved portion of said frame for said window and said mounting block means fitting snugly but slidably in said curved track means;

d) adjustable hinges with each of said hinges having a short side with an opening to allow fastening to a top end of each of said hanger strips and a slotted long side to allow loosely fastening in a center of said slot to said mounting block means thereby allowing a user to slide said hinges and said mounting blocks until said slats are exactly horizontal before trimming said slats to fit inside said frame.

3. A user fittable venetian blind comprising:

a) an arched window frame and an arched window therein b) a venetian blind hanger means, and trimmable venetian blind slats with all of said slats being as long as the width of a widest part of said window and dual double cloth hanger strips with cloth support strips for each of said slats; and a means to change the angle of said slats in said venetian blind hanger means;

c) a pair of hinges, each having one short side with an opening to allow fastening said short side to an end of said hanger means and each having a curved slotted long side to allow slidably fastening to an arched part of said window frame to allow a user to fasten said hinges to said arched part of said frame at a point wherein said slats are in a horizontal position, said user then being able to trim said slats to exactly fit said window frame.

* * * * *